United States Patent [19]

Ruffin et al.

[11] Patent Number: 4,655,410

[45] Date of Patent: Apr. 7, 1987

[54] DEVICE FOR CONTROLLING OPTICAL FIBER LAG ANGLE FOR FIBER WOUND ON A BOBBIN

[75] Inventors: Paul B. Ruffin; J. Gregory Anderson; Joe S. Hunter, all of Huntsville, Ala.

[73] Assignee: The United States of America as represented by the Secretary of the Army, Washington, D.C.

[21] Appl. No.: 812,591

[22] Filed: Dec. 23, 1985

[51] Int. Cl.[4] ..... B65H 54/28

[52] U.S. Cl. ..... 242/158 R; 242/158.2

[58] Field of Search ..... 242/158 R, 158 F, 158 B, 242/158.2, 158.4 R, 25 R

[56] References Cited

U.S. PATENT DOCUMENTS 3,319,070 5/1967 Schneider ..... 242/158 R
4,456,199 6/1984 Seibert ..... 242/158 R
4,570,875 2/1986 Buluschek ..... 242/158 R

*Primary Examiner*—Stanley N. Gilreath
*Attorney, Agent, or Firm*—Freddie M. Bush; Harold W. Hilton

[57] ABSTRACT

A device for controlling the lag angle of optical fiber as it is wound on a bobbin prior to the fiber wound bobbin being placed in a missile and payed out during flight on the missile. The device includes a laser light source which is projected into the groove between the turns of fiber being wound on the bobbin. A hemispherical detector receives the reflected laser light as it tracks the light between the grooves and any difference in the light intensity that is received by the detector is amplified and is used to speed up or slow down a reversible, variable speed motor which controls the winding of the fiber on the bobbin.

5 Claims, 4 Drawing Figures

DEVICE FOR CONTROLLING OPTICAL FIBER LAG ANGLE FOR FIBER WOUND ON A BOBBIN

DEDICATORY CLAUSE

The invention described herein may be manufactured, used, and licensed by or for the Government for governmental purposes without the payment to us of any royalties thereon.

BACKGROUND OF THE INVENTION

Fiber that is wound on a bobbin normal (at right angles) to the bobbin axes will be payed out, or dispensed, in a spiral from a missile which uses optical fibers to control the missile flight to a target. Fiber that is wound on the bobbin with a full twist will be dispensed in a straight line from the missile. Full twist is defined as the amount of twist required to cause the fiber to be dispensed in a straight line.

Fiber that is payed out in a spiral is more likely to develop "kinks" and break than is fiber that is payed out in a straight line. From the standpoint of transmission losses due to changes in indices of refraction and losses due to microbending of the fiber, there will be certain advantages realized from optimizing the amount of twist on the fiber.

Fiber that is wound on the bobbin should be wound in such a manner as to preclude skips and/or overlays for each layer of fiber. After sufficient stepback from each end, the succeeding layers of fiber should be accomplished using a preset constant tension and twist on the fiber. Failure to wind the fiber in this manner will result in high losses (attenuation) due to microbending at crossover points and will impede the fiber payoff process due to nonuniformity of the fiber windings.

The present invention in a device which allows each turn of fiber to be wound on the bobbin without skips and overlays. This task is performed independent of servo drive motor deadband or backlash.

SUMMARY OF THE INVENTION

A device for controlling optical fiber lag angle for fiber being wound on a bobbin. The bobbin is mounted on a yoke which is movably (reciprocally) mounted on a baseplate. A variable speed reversing motor is connected to a worm gear which is connected to the yoke to move the bobbin back and forth to facilitate a uniform distribution of fiber on the bobbin. Small diameter laser light (slightly less than the diameter of the fiber) is projected onto the groove between the turns of fiber being wound on the bobbin. A hemispherical detector is mounted in close proximity to the laser source so that it will receive the reflected energy from the source. The source and detector operate in the near infrared to avoid error due to visible light. By aligning the detector over the reflected laser light such that each hemisphere receives the same amount of light, the detector will always track the groove between the windings. Any difference in the light intensity that is reflected into the hemispherical detector is amplified and used to speed up or slow down the motor until the difference between the two reflected signals is zero. At that point the detector will be tracking the groove between the two windings. The output from the hemispherical detector always drives the motor at such a speed as to make the light reflecting back onto the hemispherical detector equal in both hemispheres. The optical fiber lag angle can be adjusted to the desired value at the beginning of the winding process during the initialization process. Once the lag angle is set, it will not change throughout the winding process. The detector will be turned off several turns prior to reaching the end of a given layer. Once the given layer has been completed and the fiber stepped back and begins winding in the opposite direction, the detector is again turned on to perform the same functions as before.

DESCRIPTION OF THE PREFERRED EMBODIMENT

Figure 1:
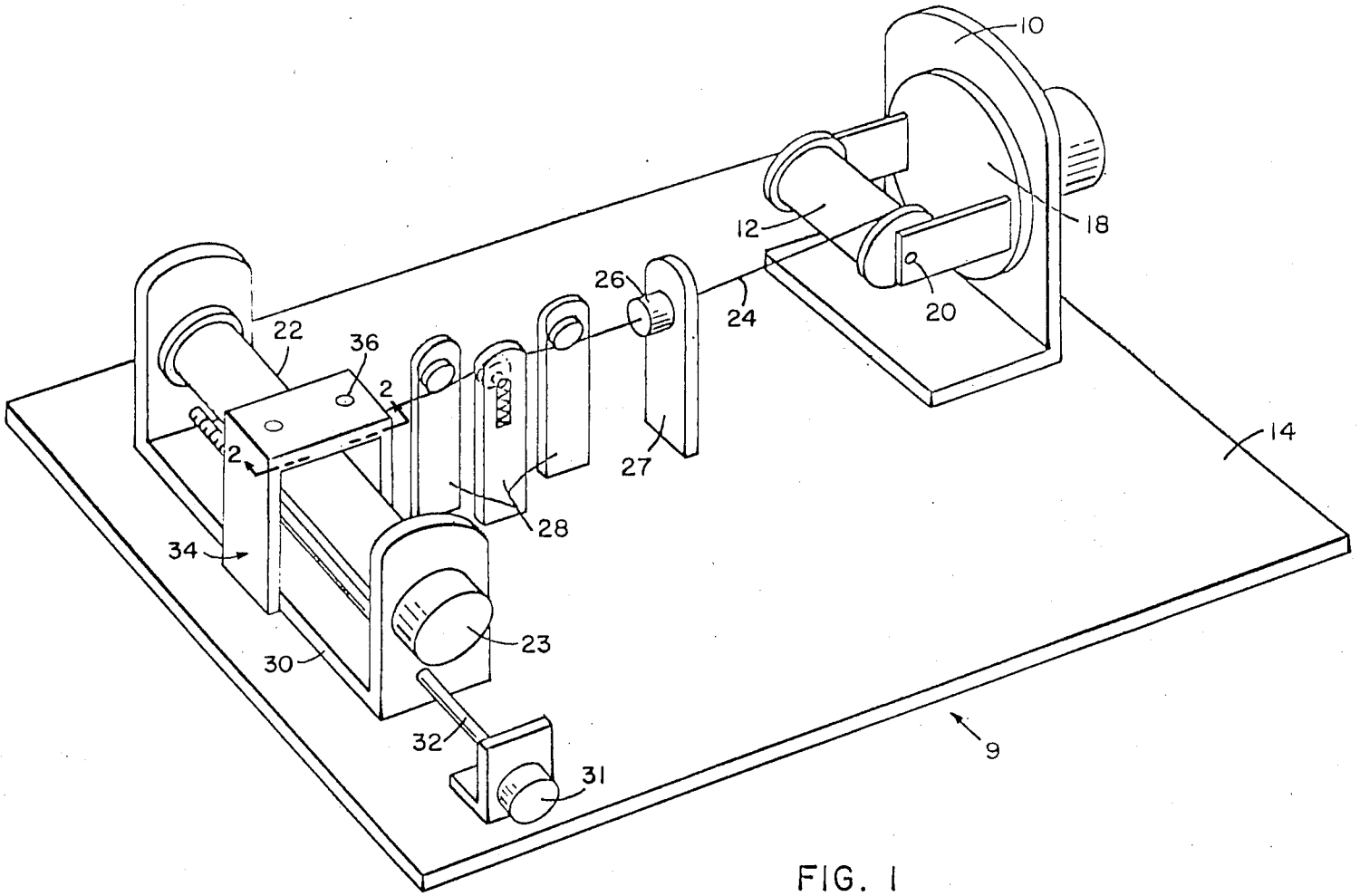
FIG. 1 is a pictorial view of an optical fiber winding mechanism having the device for controlling the optical fiber lag angle associated therein.

As seen in FIG. 1, a device 9 for passing an optical fiber from one bobbin to another while controlling optical fiber twist includes a bracket 10 having a payout bobbin 12 mounted thereon. Bracket 10 is secured to a baseplate 14. Payout bobbin 12 is attached to bracket 10 which is attached to a plate 18. A shaft 20 which operates on ball bearings and allows bobbin 12 to turn freely is mounted on payout bobbin 12. A takeup bobbin 22 is mounted on baseplate 14 in spaced relation from payout bobbin 12. An optical fiber 24 is passed from payout bobbin 12 to the takeup bobbin 22 through a twist and tension control device 26 which is mounted on a support 27 secured to baseplate 14. A tension measuring device 28 is mounted between twist and tension control device 26 and takeup spool 22 to measure the tension in the fiber. The takeup spool 22 is mounted in a yoke 30 which is movably carried on baseplate 14. A variable speed reversing motor 31 is connected to a worm gear 32 which is connected to yoke 30 to move the takeup spool 22 back and forth to facilitate a uniform distribution of optical fiber 24 on the takeup spool 22. A motor 23 attached to yoke 30 drives the takeup spool 22. The device for controlling optical fiber twist is disclosed in patent application Ser. No.: 686,048 filed Dec. 24, 1984, by Joe S. Hunter et al, now U.S. Pat. No. 4,597,255.

Figure 2:
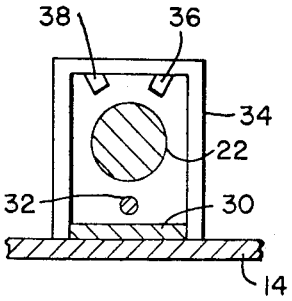
FIG. 2 is a view taken along line 2—2 of FIG. 1.
Figure 3:
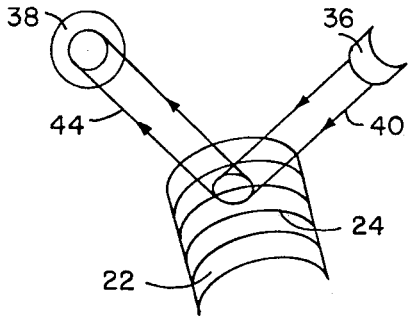
FIG. 3 is an enlarged diagrammatic, partially pictorial, view illustrating the laser for reflecting a beam from the optical fiber windings to the detector.
Figure 4:
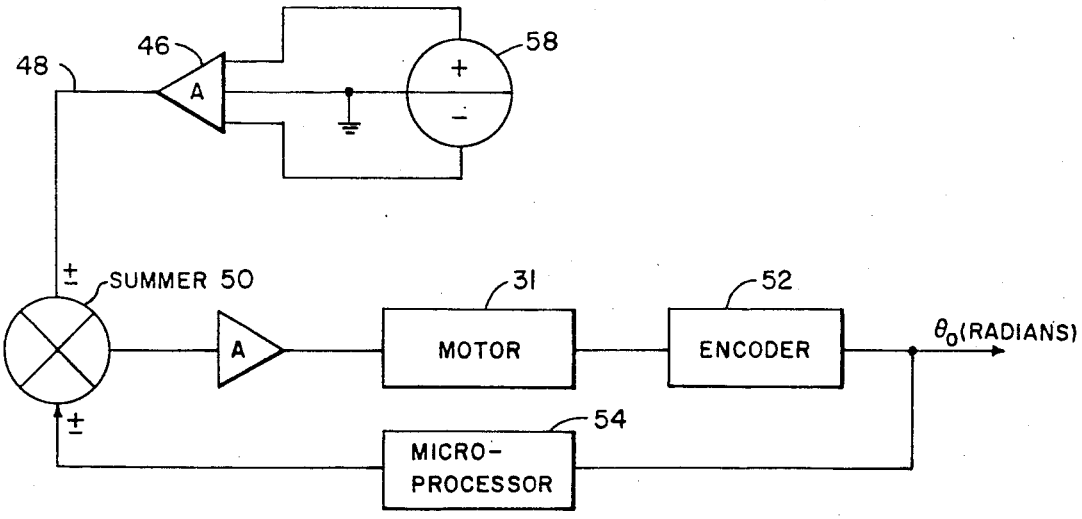
FIG. 4 is a block diagram of the hemispherical detector and control circuitry.

To control the lag angle of the optical fiber as it is wound on spool 22 a device 34 for controlling optical fiber lag angle is mounted between the tension measuring device 28 and the takeup spool (Bobbin) 22. The lag angle is defined as the angle between a line drawn normal to the takeup spool 22 axis and the fiber takeup line. The device 34 shown in FIGS. 1 and 2 is mounted to baseplate 14 and contains a laser source 36 and a hemispherical detector 38. Small diameter laser light 40 (slightly less than the diameter of the fiber) is projected from the laser source 36 onto the groove between the turns of fiber being wound on takeup bobbin 22 (see FIG. 3). Hemispherical detector 38 is mounted in close proximity to the laser source 36 so that it will receive the reflected energy 44 from the source 36. By aligning the detector 38 between the desired turns of fiber such that each hemisphere receives the same amount of light, the detector 38 will always track the groove between the windings. Any difference in the light intensity 44 that is reflected into the two hemispheres of the hemispherical detector 38 is amplified by amplifier 46 and used to speed up or slow down motor 31 until the difference between the two reflected signals is zero. The output 48 (see FIG. 4) of amplifier 46 is fed into a summer 50 which along with encoder 52 and microprocessor 54 controls servo motor 31 to insure that the lag angle remains constant. When the differences between the energy received by the two hemispherical detectors is zero, the detector will be tracking the groove between the two windings. The amplified output 48 from the hemispherical detector always drives the servo motor 31 at such a speed as required to make light reflecting back onto the hemispherical detector 38 equal in both hemispheres. The optical fiber lag angle can be adjusted to the desired value at the beginning of the winding process during the initialization phase. Once the lag angle is set, it will not change throughout the winding process. The detector will be turned off several turns prior to reaching the end of a given layer. Once the given layer has been completed and the fiber stepped back and begins winding in the opposite direction, the detector is again turned on to perform the same functions as before. The turning on and off of the detector will be controlled in the microprocessor controller 54.

After completion of the winding operation the takeup spool is placed in the missile and assumes the role of a payout spool during the mission.

A typical type of microprocessor which may be used in the present invention is the IBM PC AT.

While the optical fiber lag angle control device of the present invention has been described in conjunction with apparatus for controlling the twist of optical fiber as it is wound on a bobbin, it is to be understood that the lag angle control device should not be limited for use with an optical fiber twist device since, obviously, the lag angle control device may be used with fibers having no twist imparted thereto.

We claim:

1. Apparatus for controlling the lag angle of fiber being wound on a bobbin comprising:

a. a first spool having a fiber wound thereon;

b. a second spool rotatably mounted in spaced relation with said first spool for winding optical fiber thereon from said first spool;

c. means for reciprocal movement of said second spool whereby responsive to movement of said second spool in a first direction a layer of fiber is wound thereon and responsive to movement of said spool in a second opposite direction a layer of fiber is wound on said previously wound layer of fiber;

d. a laser stationary mounted spatially to said second spool and disposed for directing a beam of laser energy in the groove between the turns of fiber as said fiber is wound on said second spool; and, e. detector means mounted with said laser to receive the laser beam reflected from said grooves and for transmitting an electrical signal to said means for movement of said second spool whereby responsive to changes in intensity of said beam received, said speed of movement of said second spool is varied.

2. Apparatus as in claim 1 wherein said means for reciprocal movement of said second spool is a variable speed electrical motor.

3. Apparatus as in claim 2 wherein said fiber is an optical fiber.

4. Apparatus as in claim 3 wherein said laser is a laser disposed for operation in the near infrared region of the spectrum.

5. Apparatus as in claim 4 wherein said detector is a hemispherical detector operable in the near infrared, said detector disposed for receiving said reflected laser beam and for sensing changes in intensity thereof whereby said transmitted electrical signals are indicative of said changes in beam intensity.

* * * * *